US010214388B2

(12) United States Patent
Lehtinen et al.

(10) Patent No.: US 10,214,388 B2
(45) Date of Patent: Feb. 26, 2019

(54) ROPE STORAGE UNIT, A METHOD FOR INSTALLING ELEVATOR AND A METHOD FOR FABRICATING ROPE STORAGE UNIT

(71) Applicant: KONE Corporation, Helsinki (FI)

(72) Inventors: Hannu Lehtinen, Numminen (FI); Antti Ikonen, Helsinki (FI); Riku Lampinen, Helsinki (FI); Toma Cornea, Hyvinkää (FI); Antti Koskinen, Järvenpää (FI)

(73) Assignee: KONE CORPORATION, Helsinki (FI)

( * ) Notice: Subject to any disclaimer, the term of this patent is extended or adjusted under 35 U.S.C. 154(b) by 1038 days.

(21) Appl. No.: 14/325,082

(22) Filed: Jul. 7, 2014

(65) Prior Publication Data

US 2015/0060588 A1 Mar. 5, 2015

(30) Foreign Application Priority Data

Sep. 5, 2013 (EP) ..... 13183080

(51) Int. Cl.
*B66B 19/02* (2006.01)
*B65H 75/16* (2006.01)
(Continued)

(52) U.S. Cl.
CPC ..... *B66B 19/02* (2013.01); *B65H 49/30* (2013.01); *B65H 75/16* (2013.01); *B66B 7/062* (2013.01);
(Continued)

(58) Field of Classification Search
CPC ..... B66B 19/02; B66B 7/062; B65H 49/30; B65H 75/16; B65H 2701/37; Y10T 29/49826
See application file for complete search history.

(56) References Cited

U.S. PATENT DOCUMENTS 2,713,938 A * 7/1955 Snyder ..... B65D 85/04 206/395
3,375,047 A * 3/1968 Townsend ..... A01K 15/003 206/303
(Continued)

FOREIGN PATENT DOCUMENTS

CA 2296153 A1 * 7/2001 ..... B65H 49/28
DE 30 31 570 A1 2/1982
(Continued)

*Primary Examiner* — William A. Rivera
(74) *Attorney, Agent, or Firm* — Birch, Stewart, Kolasch & Birch, LLP

(57) ABSTRACT

A rope storage unit includes a rope reel, formed by a rope wound in a spiral form and a support body provided with an inner space inside which the rope reel is positioned supported by the support body. The rope is a rod having a straight form when in rest state and elastically bendable away from the straight form, the rope being under substantial bending tension in the spiral form. The support body includes one or more support members delimiting the inner space and surrounding radially the rope reel. The outer rim of the rope reel radially compresses against the one or more support members as an effect of the bending tension. A method is provided for installing an elevator rope implementing the rope storage unit, as well as to a method for fabricating the rope storage unit.

20 Claims, 5 Drawing Sheets

(51) Int. Cl.
*B66B 7/06* (2006.01)
*B65H 49/30* (2006.01)

(52) U.S. Cl.
CPC ..... *B65H 2701/37* (2013.01); *Y10T 29/49826* (2015.01)

(56) References Cited

U.S. PATENT DOCUMENTS

| | | | | | |
|---|---|---|---|---|---|
| 3,853,223 | A * | 12/1974 | Nowlain | B65D 85/04 | 206/403 |
| 4,471,921 | A * | 9/1984 | Corbin | B65H 49/30 | 242/129 |
| 5,007,597 | A | 4/1991 | Jones | | |
| 6,640,973 | B1 * | 11/2003 | Eskelinen | D21G 3/005 | 206/395 |
| 7,198,151 | B1 * | 4/2007 | Fomby | A45C 5/08 | 206/303 |
| 8,770,438 | B2 * | 7/2014 | Cahill | E05B 75/005 | 221/191 |
| 9,586,786 | B2 * | 3/2017 | Lehtinen | B65H 75/16 | |
| 2010/0133046 | A1 | 6/2010 | Allwardt et al. | | |

FOREIGN PATENT DOCUMENTS

| | | | |
|---|---|---|---|
| EP | 0 959 035 | A2 | 11/1999 |
| WO | WO 2007/118929 | A1 | 10/2007 |
| WO | WO 2009/090299 | A1 | 7/2009 |
| WO | WO 2011/004071 | A2 | 1/2011 |
| WO | WO 2013/041771 | A1 | 3/2013 |

* cited by examiner

ROPE STORAGE UNIT, A METHOD FOR INSTALLING ELEVATOR AND A METHOD FOR FABRICATING ROPE STORAGE UNIT

FIELD OF THE INVENTION

The invention relates to storing of a rope, to installing of an elevator rope as well as a fabricating a rope storage unit. The rope is, in particular, a rope for an elevator meant for transporting passengers and/or goods.

BACKGROUND OF THE INVENTION

Storing of a rope may be needed in various stages of its lifetime. The storing is conventionally implemented by forming a rope reel of the rope so that it can be stored and/or transported as a compact unit. In the field of elevators, storing is usually needed for transporting the rope to the site, and further to the specific installation location where the rope can be unwound and installed in the elevator. Ropes are typically irreversibly flexible such that after bending the rope into a curve, it does not reverse back to its original form. These kinds of ropes usually comprise load bearing members made of twisted wires or equivalents. This kind of rope is easy to wind around a drum where it can be stored until a later unwinding. Also such ropes exist, which are rod-like and have a straight form when in rest state. A this kind of rope is presented in patent publication WO2009090299 A1. This kind of ropes are relatively rigid, but elastically bendable, and the rope self-reverses back to a straight form from bent form in rest state, i.e. after all bending directed to it ceases. A known way to store this kind of ropes has been to form a rope reel of the rope by winding it around a drum and subsequently tying the rope end against the outer rim of the rope reel so that the rope reel cannot unwind. This known method has caused difficulties in later unwinding process. In particular, after releasing the rope end, the rope end has been difficult to control. Especially, it has been found out that the bending tension is prone to cause difficulties in unwinding of the rope. The rope tends to straighten as an effect of said bending tension and may easily escape from the hands of the person preparing the unwinding operation. Avoiding this type of events has necessitated auxiliary means for controlling the rope end once it has been freed from the reel.

BRIEF DESCRIPTION OF THE INVENTION

The object of the invention is, inter alia, to solve previously described drawbacks of known solutions and problems discussed later in the description of the invention. The object of the invention is to introduce a rope storage unit whereby an elastically bendable relatively rigid rope can be stored as a rope reel in a simple and stabile way. An object of the invention is also to introduce a method for installing of an elevator rope utilizing said rope storage unit, whereby simplicity of the rope installation process can be facilitated. An object of the invention is also to introduce a method for fabricating a rope storage unit.

It is brought forward a new rope storage unit, comprising a rope reel, formed by a rope wound in a spiral form, and a support body provided with an inner space inside which the rope reel is positioned supported by the support body. The rope is a rod having a straight form when in rest state and elastically bendable away from the straight form. The rope is thereby self-reversible to straight form from bent form. The rope is under substantial bending tension in said spiral form. The support body comprises one or more support members delimiting said inner space and surrounding radially said rope reel, the outer rim of the rope reel radially compressing against said one or more support members as an effect of said bending tension. Said support member/members thereby delimit(s) the radius of the rope reel from expanding, and thereby block the rope of the reel from straightening. The rope is preferably a rope for an elevator, in particular for suspending at least an elevator car. Thus the rope can be stored as a rope reel in a simple and stabile way. The rope storage unit is in particular a movable storage unit so that the rope can be transported within the rope storage unit to an installation site of an elevator, for instance. Preferably the rope storage unit is of a size and weight transportable with a fork lift.

In a preferred embodiment said rope has width larger than thickness thereof in transverse direction of the rope, and the rope is wound in said spiral form by bending it around an axis extending in width-direction of the rope. Thus, the rope settles easily in the spiral form and formation of twist can be avoided.

In a preferred embodiment the rope is wound in a spiral form with several rope rounds, including at least an outermost rope round having an outer rim and forming at least part of the aforementioned outer rim of the rope reel, radially compressing against said one or more support members as an effect of said bending tension, as well as several inner rope rounds each having an outer rim radially compressing, as an effect of said bending tension, against the inner rim of the rope round next in radial direction.

In a preferred embodiment said rope comprises one or more load bearing members made of composite material comprising reinforcing fibers in polymer matrix. This kind of structure facilitates good load supporting properties, but also requires a great force to bend the rope into spiral form, which causes a great bending tension. Thereby, the storing solution as disclosed is especially advantageous with this rope. Said reinforcing fibers are preferably carbon fibers. These fibers facilitate rope lightness and tensile stiffness, thereby making the rope well suitable for elevator use. In this case especially, a great force to bend the rope into spiral form is required. Thereby, the storing solution as disclosed is especially advantageous with this rope.

In a preferred embodiment said load bearing member(s) is/are parallel with the length direction of the rope. The straight structure provides a high bending rigidity, whereby a great force to bend the rope into spiral form is required. Thereby, the storing solution as disclosed is especially advantageous with this rope.

In a preferred embodiment the support member(s) are in supporting contact with the outer rim of the rope reel along majority of the rim of the rope reel. Thus, the supporting force is evenly distributed and the rope is protected by the support member(s). In the preferred embodiment, the support member(s) delimit a cylindrical inner space and surround(s) radially said rope reel. The inner rim of the cylindrical inner space is in contact with the rope reel along majority of the rim of the rope reel, more preferably along more than 80% of the rim of the rope reel, or even along complete rim of the rope reel.

In a preferred embodiment said reinforcing fibers are parallel with the length direction of the rope. The straight structure provides a high bending rigidity, whereby a great force to bend the rope into spiral form is required. Thereby, the storing solution as disclosed is especially advantageous with this rope. Preferably, the load bearing member(s), as well as the reinforcing fibers are parallel with the length direction of the rope, and thereby substantially untwisted relative to each other. The fibers are thus aligned with the force when the rope is pulled, which facilitates good tensile stiffness. Also, behaviour during bending is advantageous as the load bearing members retain their structure during bending. The wear life of the rope is, for instance long because no chafing takes place inside the rope. Preferably, individual reinforcing fibers are homogeneously distributed in said polymer matrix. Preferably, over 50% of the cross-sectional square area of the load-bearing member consists of said reinforcing fiber.

In a preferred embodiment each of said load bearing member(s) has width larger than thickness thereof as measured in width-direction of the rope.

In a preferred embodiment said one or more load bearing members is/are embedded in elastomeric coating.

In a preferred embodiment the rope comprises a plurality of said load bearing members adjacent in width-direction of the rope.

In a preferred embodiment the rope reel is formed by the rope wound in a two-dimensional spiral form.

In a preferred embodiment that the rope reel is formed by the rope wound in a three-dimensional spiral form.

In a preferred embodiment it comprises a second rope reel, consisting of a second rope wound in a spiral form the second rope being a rod having a straight form when in rest state and elastically bendable away from the straight form. The rope is thereby self-reversible to straight form from bent form. The second rope is under substantial bending tension in said spiral form, the outer rim of the second rope reel radially compressing against the inner rim of said first rope reel, directly or via intermediate support elements, such as paddings, surrounding the second rope reel, as an effect of said bending tension.

In a preferred embodiment the second rope is wound in a spiral form with several rope rounds, including at least an outermost rope round having an outer rim, and forming at least part of the aforementioned outer rim of the second rope reel, radially compressing against the inner rim of said first rope reel, directly or via intermediate support elements surrounding the second rope reel, as an effect of said bending tension, as well as several inner rope rounds each having an outer rim radially compressing, as an effect of said bending tension, against the inner rim of the rope round next in radial direction.

In a preferred embodiment said one or more support members delimit(s) a cylindrical inner space. Said cylindrical inner space has preferably in axial direction open side via which the reel can be brought inside the inner space and/or via which the rope can be guided away from the rope reel.

In a preferred embodiment the support body comprises a support drum formed by said one or more support members delimiting a cylindrical inner space.

In a preferred embodiment the support drum is made of one or more bent fiberboard members bent or otherwise molded into curved shape. The curved form is preferably an arc form with inner radius of curvature corresponding to that of the outer radius of rope reel.

In a preferred embodiment the support body comprises a support shaft via which the rope storage unit can be rotatably mounted.

In a preferred embodiment the support shaft is positioned within the free central space inside the rope reel, coaxially with the rope reel.

In a preferred embodiment the rope reel delimit(s) a free central space inside the rope reel, and the rope wound in a spiral form has an end extending from the outer rim of the rope reel and an end extending from the inner rim of the rope reel, the rope being unwindable by guiding the end extending from the inner rim away from the rope reel via said free central space. Said central space is preferably cylindrical.

In a preferred embodiment the rope is wound in a spiral form with several rope rounds, including at least an radially outermost rope round, and an radially innermost rope round, rope being unwindable rope round by rope round starting from the innermost rope round.

In a preferred embodiment the rope has a first end and a second end, the first end particularly forming an end for the outermost round and the second end particularly forming an end for the innermost rope round.

In a preferred embodiment the inner rim of the rope reel delimit(s) a free central space inside the rope reel, the central space having in axial direction open side via which the rope can be guided away from the rope reel.

In a preferred embodiment the rope is wound in a spiral form with several rope rounds, intermediate rope rounds between the innermost and outermost rope rounds, the intermediate rope rounds radially compressing against the next outer rope round as an effect of said bending tension.

It is brought forward a new method for installing an elevator rope, comprising the steps of providing a rope storage unit according to any one of the preceding claims; and unwinding the rope from the rope storage unit; and connecting the rope to one or more movable elevator units, said units including at least an elevator car and preferably also a counterweight.

In a preferred embodiment said unwinding comprises unwinding the rope by rotating the rope support body supporting the rope reel.

In a preferred embodiment said unwinding comprises unwinding the rope starting from the center.

In a preferred embodiment the method comprises before said unwinding mounting the rope storage unit rotatably (via a support shaft comprised in the support body).

In a preferred embodiment the method comprises before said unwinding guiding the rope to pass via a rope guide mounted stationary at proximity of the rope reel.

In a preferred embodiment the rope is wound in a spiral form with several rope rounds, including at least an radially outermost rope round, and an radially innermost rope round, and in said unwinding the rope is unwound round by rope round starting from the innermost rope round.

In a preferred embodiment the rope reel delimit(s) a free central space, which inside the rope reel, and the rope wound in a spiral form has an end extending from the inner rim of the rope reel, and said unwinding comprises guiding said end away from the rope reel via said free central space. Thus, the rope can be unwound starting from the center. The rope can thus be unwound so that each round of the rope still unwound and remaining on the rope reel stays tensioned against the next outer round, the outermost round staying tensioned against said support member(s). Thereby, self-progressing of the unwinding can be avoided and the unwinding process can be kept easily under control.

In a preferred embodiment the inner rim of the rope reel delimit(s) a free central space inside the rope reel, the central space having in axial direction open side via which the rope is guided away from the rope reel. Thus the rope can be unwound from the side of the reel.

It is brought forward a new method for fabricating an elevator rope storage unit, comprising the steps of providing a rope, which is a rod having a straight form when in rest state and elastically bendable away from the straight form. The rope is thereby self-reversible to straight form from bent form. The method further comprises providing a support body provided with an inner space, the support body comprising one or more support members delimiting said inner space; forming a rope reel by winding the rope) in a spiral form; positioning the rope inside the inner space such that it is supported by the support body and surrounded radially by said one or more support members, and such that the rope is under substantial bending tension in said spiral form, the outer rim of the rope reel radially compressing against said one or more support members as an effect of said bending tension. Said support member/members thereby delimit the radius of the rope reel from expanding, and thereby block the rope reel from straightening. The rope storage unit can be thus fabricated to have structure as defined anywhere above or elsewhere in the application.

In a preferred embodiment the rope reel is positioned inside the inner space after said forming a rope reel by winding the rope in a spiral form.

In a preferred embodiment said one or more support members radially delimit(s) a cylindrical inner space having in axial direction open side, and the rope reel is positioned inside the inner space by moving the rope reel inside the inner space via the in axial direction open side of the cylindrical inner space after said forming a rope reel by winding the rope in a spiral form.

In a preferred embodiment in said forming, the rope is wound in a spiral form around a support hub, and thereafter removed from the hub while keeping the rope reel from unwinding. For this purpose, the rope can be tied together with a tie, band or equivalent, which is later removed.

In a preferred embodiment the load bearing member(s) of the rope cover(s) majority, preferably 70% or over, more preferably 75% or over, most preferably 80% or over, most preferably 85% or over, of the width of the cross-section of the rope. In this way at least majority of the width of the rope will be effectively utilized and the rope can be formed to be light and thin in the bending direction for reducing the bending resistance.

In a preferred embodiment the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. This kind of matrix also facilitates the elastic bending of the rope, yet requiring a great bending force causing great bending tension. Thereby, the storing solution as disclosed is especially advantageous with this rope.

The elevator as describe anywhere above is preferably, but not necessarily, installed inside a building. The car is preferably arranged to serve two or more landings. The car preferably is arranged to respond to calls from landing(s) and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
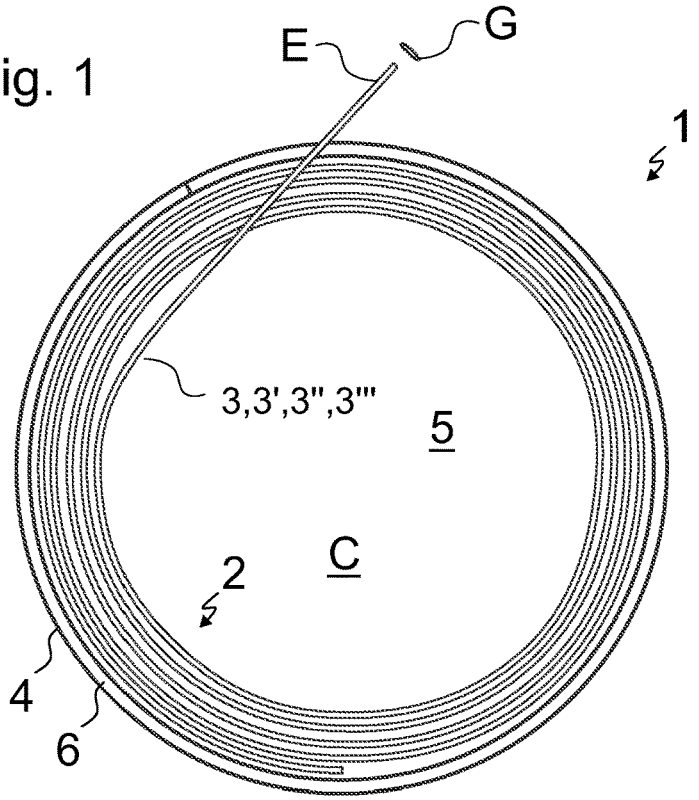
FIG. 1 illustrates a rope storage unit according to an embodiment.
Figure 2:
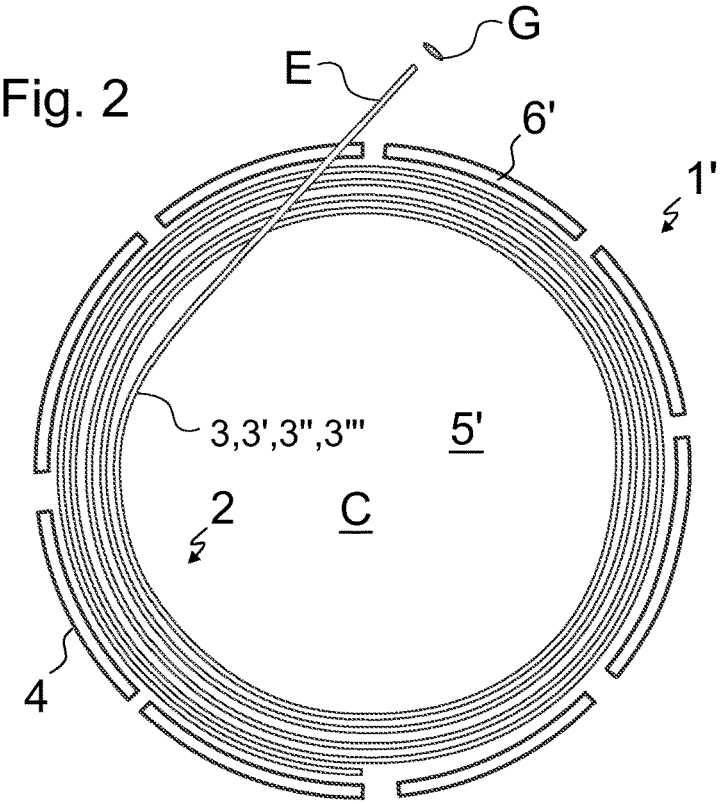
FIG. 2 illustrates a rope storage unit according to another embodiment.

FIGS. 1 and 2 illustrate embodiments of a rope storage unit 1,1'. In both embodiments, the rope storage unit 1,1' comprises a rope reel 2, formed by a rope 3,3',3",3'" wound in a spiral form. The rope storage unit 1, 1' further comprises a support body 4,4' provided with an inner space 5,5' inside which the rope reel 2 is positioned supported by the support body 4,4'. The rope 3,3',3",3'" has two ends, i.e. a first end and a second end. The rope 3,3',3",3'" is a rigid rope, more specifically it has a rod-like structure. The rod, i.e. the rope 3,3',3",3'", has a straight form when in rest state. In particular, the rod i.e. the rope 3,3',3",3'", is elastically bendable away from the straight form. Thereby, it self-reverses to straight form from bent form. For this reason, the rope 3,3',3",3'" is under substantial bending tension in said spiral form. The support body 4,4' comprises one or more support members 6,6'. The support members 6,6' delimit and surround radially, in particularly its/their inner face(s), said inner space 5,5' said rope reel 4,4'. In the embodiment as illustrated in FIG. 1 the support body 4 comprises a single support member 6 said inner space 5 and surrounding radially said rope reel 4, whereas in the embodiment as illustrated in FIG. 2 the support body 4' comprises a single support member 6' said inner space 5' and surrounding radially said rope reel 4'. The outer rim of the rope reel 2 radially compresses against said one or more support members 6,6' as an effect of said bending tension, said support member/members 6,6' thereby delimiting the radius of the rope reel 2 from expanding forced by the bending tension. Thereby said support member/members 6,6' blocks/block the rope of the rope reel 2 from straightening.

As illustrated in FIGS. 1 and 2, the rope 3,3',3",3'" is wound in a spiral form with several rope rounds, including at least an outermost rope round having an outer rim, and forming at least part of the aforementioned outer rim of the rope reel, radially compressing against said one or more support members 6,6' as an effect of said bending tension, as well as several inner rope rounds each having an outer rim radially compressing, as an effect of said bending tension, against the inner rim of the rope round next in radial direction. The rope reel 2 is formed by the rope 3,3',3",3" wound in either a two-dimensional spiral form, illustrated in FIGS. 1 to 2, in which case substantially all the rope rounds are on a same plane. Alternatively, the rope reel 2 is formed by the rope 3,3',3",3'" wound in either a three-dimensional spiral form whereby substantially all the rope rounds are not on a same plane and the rope rounds pass in a slight angle relative to radial plane of the rope reel back and forth in axial direction as it is commonly known in the field of winding rope reels or corresponding reels.

The rope 3,3',3",3'" is wound in a spiral form with several rope rounds, including at least an radially outermost rope round, and an radially innermost rope round, as well as intermediate rope rounds between the innermost and outermost rope rounds, the innermost rope round as well as each intermediate rope round radially compressing against the next (outer) rope round as an effect of said bending tension.

The rope reel 2, in particular the inner rim of rope reel, in particular the innermost rope round(s) thereof, delimit(s) a free central space C inside the rope reel 2. The central space C is thereby at least substantially round in cross section as viewed in axial direction of the rope reel 2. The rope 3,3',3",3''' is unwindable rope round by rope round starting from the innermost rope round. When the rope 3,3',3",3''' is of belt-like structure, and/or when the rope reel 2 is wound three-dimensional spiral form, the central space C is cylindrical. The central space C has a side in axial direction of the rope reel 2, which is fully or at least partially open or openable via which side the rope 3,3',3",3''' can be guided away from the rope reel 2. The rope 3,3',3",3''' wound in a spiral form has an end E extending from the outer rim of the rope reel 2 and an end extending from the inner rim of the rope reel 2, the rope being unwindable by guiding the inner end away from the rope reel 2 via said free central space C. Thus, the rope 3,3',3",3''' can be unwound so that each round of the rope 3,3',3",3''' still unwound and remaining on the rope reel 2 stays tensioned against the next outer round, the outermost round staying tensioned against said support member(s) 6, 6'. Thereby, self-progressing of the unwinding can be avoided and the unwinding process can be kept easily under control. Thereby, also safety is improved.

The rope is preferably a belt-like rope. That is, the rope 3,3',3",3''' has width larger than thickness thereof in transverse direction of the rope 3,3',3",3''' Then, the rope 3,3',3", 3''' is wound in said spiral form by bending it around an axis extending in width-direction of the rope 3,3',3",3'''. Thus, the rope 3,3',3",3''' settles easily in the spiral form. Due to the belt-like construction, it resists from strongly bending away from a coplanar configuration. Thus, the rope reel 2 maintains well its spiral reel configuration and is not prone to unwind accidentally. In this way, also formation of twist can be avoided.

The support body 4, 4' preferably comprises a support drum formed by said one or more support members 6,6', which delimit(s) a cylindrical inner space 5,5'. The support drum is made of one or more bent fiberboard members. In the embodiment of FIG. 1 the support drum is made of one fiberboard member 6 bent into curved shape and in the embodiment of FIG. 2 the support drum is made of several fiberboard members 6 bent into curved shape, fiberboard members 6 together forming said drum. The curved form is an arc form providing an inner radius of curvature for the support member(s) 6,6', which corresponds to that of the outer radius of the rope reel 2 radially compressing against the support members 6,6'. Said cylindrical inner space 5,5' has in axial direction an open or at least openable side so that the rope 3,3',3",3''' can be positioned inside it via the open side as a fully in spiral form wound rope reel 2.

Figure 3:
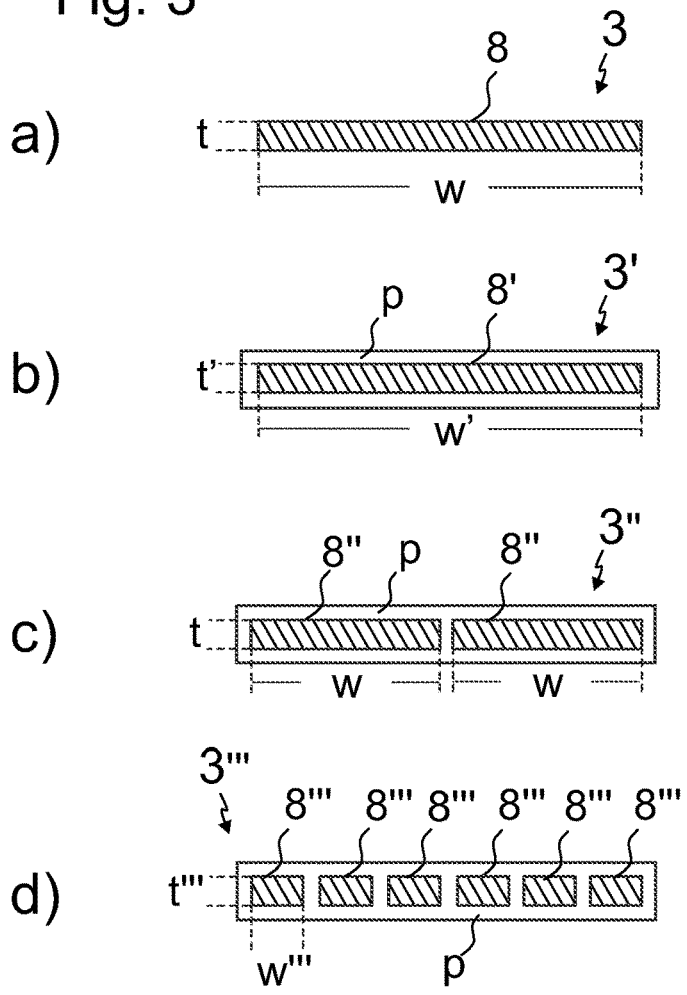
FIG. 3 illustrates alternative preferred rope structures.

Said rope 3,3',3",3''' is preferably such that it comprises one or more load bearing members 8, 8', 8", 8''' made of composite material comprising reinforcing fibers f in polymer matrix m. Preferred alternatives for the cross section of the rope 3,3',3",3''' are presented in FIGS. 3*a* to 3*d*. Preferably, the reinforcing fibers f are carbon fibers. Thus a light rope with high tensile stiffness can be obtained. Said load bearing member(s) 8, 8', 8", 8''' is/are parallel with the length direction of the rope. For example with this structure the rope 3,3',3",3''' is elastically bendable away from the straight form. Thereby, it self-reverses to straight form from bent form However, it is rigid to bend and therefore using the rope storage unit 1, 1' to store this rope is advantageous. Also, using other reinforcing fibers as fibers f of the composite material, such as glass fiber, can provide these properties for the rope 3,3',3",3'''. Said reinforcing fibers are preferably also parallel with the length direction of the rope so the tensile stiffness can be maximized. It is preferable, that each of said load bearing member(s) 8, 8', 8", 8''' has width w,w',w",w''' larger than thickness t,t',t",t''' thereof as measured in width-direction of the rope 3,3',3",3'''. In this way a large cross-sectional area for the load bearing member/parts 3,3',3",3''' is achieved, without weakening the bending capacity around an axis extending in the width (extending from left to right in FIG. 3) direction of the rope 3,3',3",3'''. A small number of wide load bearing members comprised in the rope leads to efficient utilization of the width of the rope, thus making it possible to keep the rope width of the rope in advantageous limits.

Each rope 3, 3' as illustrated in FIGS. 3*a* and 3*b* comprises only one load bearing member 8,8'. Each rope 3",3" as illustrated in FIGS. 3*c* and 3*d* comprises a plurality of load bearing members 8",8'''. The load bearing members 8",8" are adjacent in width-direction of the rope 3",3". They are parallel in length direction of the rope and coplanarly positioned. Thus the resistance to bending in their thickness direction is small. The preferred internal structure for the load bearing member(s) 8, 8',8",8''' is disclosed elsewhere in this application, in particular in connection with FIG. 4.

The load bearing member 8 can be without an elastomeric coating as presented in FIG. 3*a*. Thereby, the load bearing member may form as such the rope 3. The load bearing members 8',8",8" of each rope presented in FIGS. 3*b* to 3*d* is/are surrounded with a coating p in which the load bearing members 8',8",8" are embedded. It provides the surface for contacting a drive wheel of the elevator, for instance. Coating p is preferably of polymer, most preferably of an elastomer, most preferably polyurethane, and forms the surface of the rope 3',3",3'''. It enhances effectively the ropes frictional engagement to the drive wheel 3 and protects the rope. For facilitating the formation of the load bearing member 8, 8', 8", 8''' and for achieving constant properties in the length direction it is preferred that the structure of the load bearing member 8, 8' continues essentially the same for the whole length of the rope 3,3',3",3'''.

As mentioned, the rope 3,3',3",3''' is belt-shaped, particularly having two wide sides opposite each other. The width/thickness ratio of the rope is preferably at least at least 4, more preferably at least 5 or more, even more preferably at least 6, even more preferably at least 7 or more, yet even more preferably at least 8 or more. In this way a large cross-sectional area for the rope is achieved, the bending capacity around the width-directional axis being good also with rigid materials of the load bearing member. Thereby the rope suits well to be positioned in the rope support structure 6,6' in bent form, as well as to the use of suspending an elevator car.

The rope 3,3',3",3''' is preferably furthermore such that the aforementioned load bearing member 8 or a plurality of load bearing members 8', 8", 8''', comprised in the rope 3,3',3",3''', together cover majority, preferably 70% or over, more preferably 75% or over, most preferably 80% or over, most preferably 85% or over, of the width of the cross-section of the rope 3,3',3",3''' for essentially the whole length of the rope 3,3',3",3'''. Thus the supporting capacity of the rope with respect to its total lateral dimensions is good, and the rope does not need to be formed to be thick. This can be simply implemented with the composite as specified elsewhere in the application and this is particularly advantageous from the standpoint of, among other things, service life and bending rigidity in elevator use. The width of the rope 3,3',3",3''' is thus also minimized by utilizing their width efficiently with wide load bearing member and using composite material. Individual belt-like ropes and the bundle they form can in this way be formed compact.

Figure 4:
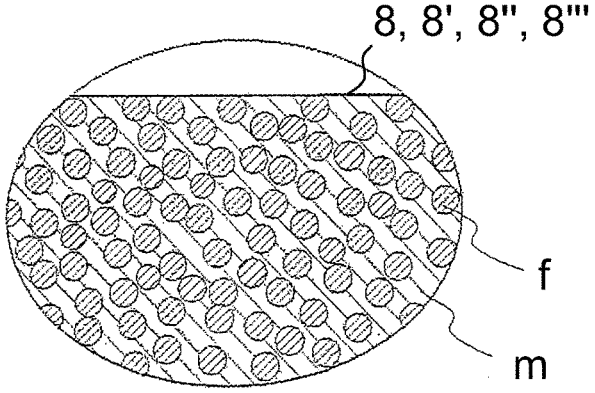
FIG. 4 illustrates a preferred internal structure for the load bearing member.
Figure 5:
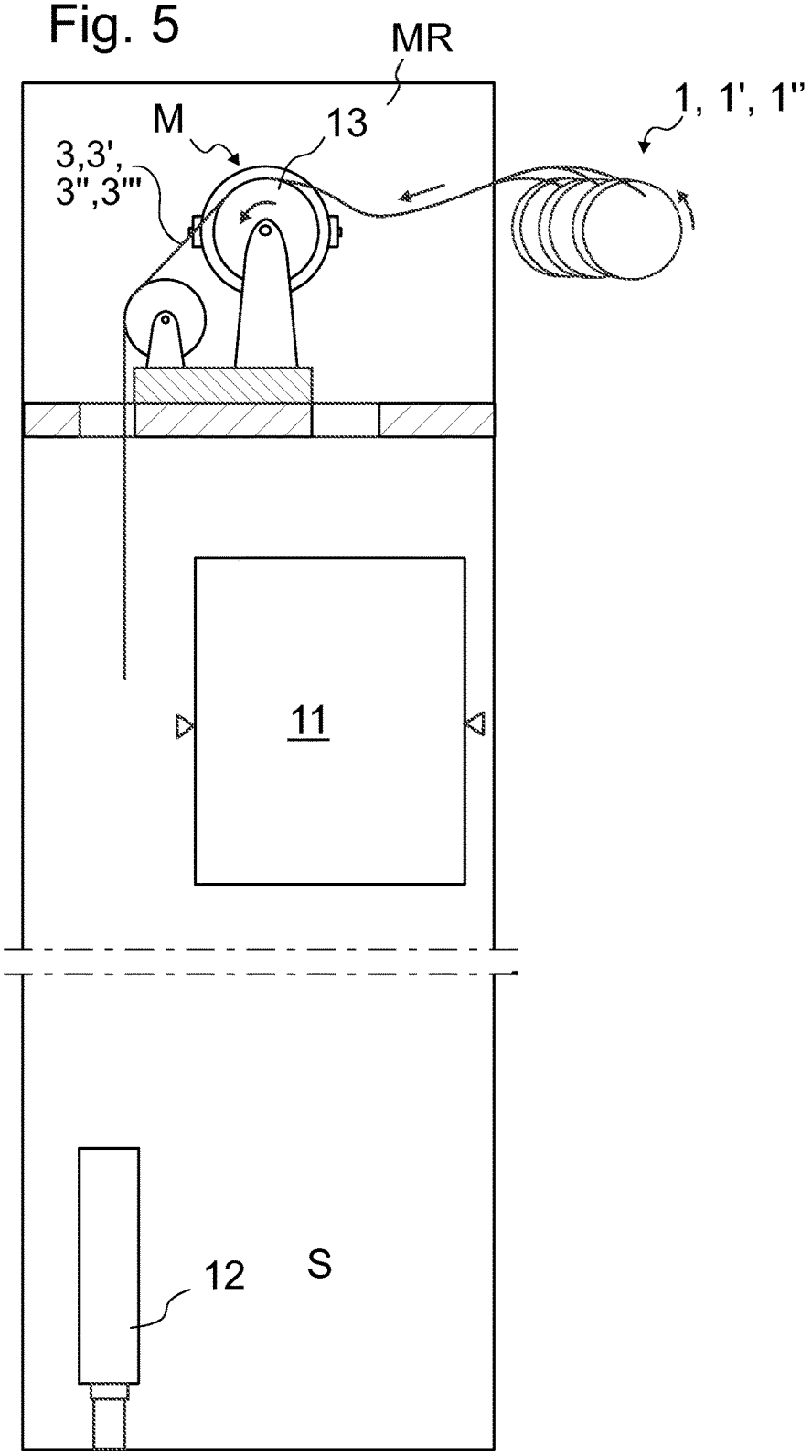
FIG. 5 illustrates an installation method.

The inner structure of the load bearing member 8, 8',8",8'" is more specifically as illustrated in FIG. 4 and described in the following. The load bearing member 8, 8',8",8'" with its fibers oriented in length direction of the rope, i.e. parallel with the length direction of the rope, for which reason the rope retains its structure when bending. Individual fibers are thus oriented in the length direction of the rope. In this case the fibers f are aligned with the force when the rope is pulled in its length direction. Individual reinforcing fibers f are bound into a uniform load bearing member with the polymer matrix m in which they are embedded. Thus, each load bearing member 8, 8',8",8'" is one solid elongated rodlike piece. The reinforcing fibers f are preferably long continuous fibers in the length direction of the rope 3,3',3",3'" and the fibers f preferably continue for the distance of the whole length of the rope 3,3',3",3'". Preferably as many fibers f as possible, most preferably essentially all the fibers f of the load bearing member 8, 8',8",8'" are oriented in length direction of the rope. The reinforcing fibers f are in this case essentially untwisted in relation to each other. Thus the structure of the load bearing member can be made to continue the same as far as possible in terms of its cross-section for the whole length of the rope. The reinforcing fibers f are preferably distributed in the aforementioned load bearing member 8, 8',8",8'" as evenly as possible, so that the load bearing member 8, 8',8",8'" would be as homogeneous as possible in the transverse direction of the rope. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong to behave advantageously with carbon fiber. Alternatively, e.g. polyester or vinyl ester can be used. Alternatively some other materials could be used. FIG. 4 presents a partial cross-section of the surface structure of the load bearing member 8, 8',8",8'" as viewed in the length direction of the rope, presented inside the circle in the figure, according to which cross-section the reinforcing fibers f of the load bearing members 8, 8',8",8'" are preferably organized in the polymer matrix m. FIG. 5 presents how the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by immersing them together in the molten material of the polymer matrix. In this case the gaps of individual reinforcing fibers bound to each other with the polymer matrix comprise the polymer of the matrix. In this way a great number of reinforcing fibers bound to each other in the length direction of the rope are distributed in the polymer matrix. The reinforcing fibers are preferably distributed essentially evenly in the polymer matrix such that the load bearing member is as homogeneous as possible when viewed in the direction of the cross-section of the rope. In other words, the fiber density in the cross-section of the load bearing member does not therefore vary greatly. The reinforcing fibers f together with the matrix m form a uniform load bearing member, inside which abrasive relative movement does not occur when the rope is bent. The individual reinforcing fibers of the load bearing member 8, 8',8",8'" are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix m is immediately against the reinforcing fiber but alternatively a thin coating, e.g. a primer arranged on the surface of the reinforcing fiber in the manufacturing phase to improve chemical adhesion to the matrix m material, can be in between. Individual reinforcing fibers are distributed evenly in the load bearing member 8, 8',8",8'" such that the gaps of individual reinforcing fibers f are filled with the polymer of the matrix m. Most preferably the majority, preferably essentially all of the gaps of the individual reinforcing fibers f in the load bearing member are filled with the polymer of the matrix m. The matrix m of the load bearing member 8, 8',8",8'" is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix m is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix m is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix m. Most preferably such that approx. 60% of the surface area is of reinforcing fiber and approx. 40% is of matrix m material (preferably epoxy). In this way a good longitudinal strength of the rope is achieved.

FIG. 5 illustrates a method for installing an elevator rope according to a preferred embodiment. In the method rope storage units 1, 1' are provided, which are presented elsewhere in the application. A rope 3,3',3",3'" is unwound from each rope storage unit 1, 1' as illustrated in FIG. 5, and thereafter connected to movable elevator units 11,12, i.e. to an elevator car 11 and a counterweight 12, to suspend these. In the preferred embodiment, a first end of the rope 3,3',3", 3'" is connected to the car 11 and the second end to the counterweight 12. In the method a plurality of ropes 3,3', 3",3'" are installed this way simultaneously. The elevator comprises a hoistway S, an elevator car 1 and a counterweight 2 installed with the method to be vertically movable in the hoistway S. The elevator further includes a drive machine M which is installed with the method to drive the elevator car 1 under control of an elevator control system (not shown). During said unwinding the rope 3,3',3",3'" is guided to pass over a drive wheel 13 of the drive machine M. The drive machine M is in this embodiment mounted inside a machine room MR, but the elevator could alternatively have a machine roomless configuration. The drive wheel 13 is arranged to engages said ropes 3,3',3",3'" passing over the drive wheel 13 and suspending the elevator car 11 and the counterweight 12. Thus, driving force can be transmitted from the motor to the car 11 and counterweight 12 via the drive wheel 13 and the ropes 3,3',3",3'" so as to move the car 11 and counterweight 12. Said unwinding comprises unwinding the rope 3,3',3",3'" by rotating the rope support body 6,6' supporting the rope reel 2. The method comprises before said unwinding mounting the rope storage unit rotatably (via a support shaft comprised in the support body). Also, the method comprises before said unwinding guiding the rope 3,3',3",3'" to pass via a rope guide G mounted stationary at proximity of the rope reel 2. The elevator car 11 and the counterweight may be at any suitable position during said unwinding. However, when the connecting of the rope 3,3',3",3'" to the car is performed, preferably the car is at an upper end of the hoistway S and the counterweight resting on its buffer at the lower end of the hoistway S so as to fit their positions to suit the rope length.

As elsewhere explained, the rope 3,3',3",3'" is wound in a spiral form with several rope rounds, including at least an radially outermost rope round, and an radially innermost rope round. In said unwinding the rope is unwound round by rope round starting from the innermost rope round. The rope reel delimit(s) a cylindrical free central space C inside the rope reel 2, and the rope 3,3',3",3'" wound in a spiral form has an end E extending from the inner rim of the rope reel 2. Said unwinding comprises guiding the inner end E away from the rope reel 2 via said free central space C. Therefrom the rope 3,3',3",3'" passes to a at least substantially stationary mounted rope guide G, which may be in the form of a guide aperture formed by a plastic bush for example. The free central space (which is preferably cylindrical) inside the rope reel 2 delimited by the inner rim of the rope reel 2 has preferably in axial direction or the reel 2 open (or at least openable) side via which the rope 3,3',3",3'" is guided away from the rope reel 2. The rope 3,3',3",3'" wound in a spiral form further has another end extending from the outer rim of the rope reel 2, which is unwound from the reel 2 after all the rest of the rope 3,3',3",3'" is already unwound from the rope reel 2.

The rope storage unit 1, 1' is preferably fabricated with a method for fabricating an elevator rope storage unit. In a preferred method a rope 3,3',3",3'" is provided, which is a rod having a straight form when in rest state and elastically bendable away from the straight form. Additionally, a support body 4,4' is provided having an inner space 5,5', and comprising one or more support members 6,6' delimiting said inner space 5,5'. A rope reel 2 is formed by winding the rope 3,3',3",3'" in a spiral form and positioned inside the inner space 5,5' such that it is supported by the support body 4,4' and surrounded radially by said one or more support members 6,6', and such that the rope 3,3',3",3'" is under substantial bending tension in said spiral form, the outer rim of the rope reel 2 radially compressing against said one or more support members 6,6' as an effect of said bending tension, said support member/members thereby delimiting the radius of the rope reel 2 from expanding, and thereby blocking the rope reel 2 from straightening.

Preferably, the rope reel 2 is positioned inside the inner space 5,5' after completion of the forming a rope reel 2 by winding the rope 3,3',3",3'" in a spiral form. Thus, the rope 3,3',3",3'" is moved to be positioned inside the inner space 5,5' as a complete rope reel 2. It is preferable, that said one or more support members 6,6' radially delimit(s) a cylindrical inner space 5,5' having in axial direction open side, and the rope reel 2 is positioned inside the inner space 5,5' by moving the rope reel inside the inner space (5,5') via the in axial direction open side of the cylindrical inner space 5,5' after said forming a rope reel 2 by winding the rope 3,3',3",3'" in a spiral form. It is preferable, that in said forming, the rope (3,3',3",3'") is wound in a spiral form around a support hub, and thereafter removed from the hub while prohibiting the rope reel 2 from unwinding. For this purpose, the rope reel 2 can be tied together with a tie, band or equivalent, enveloping the rope bundle (a loop form element passing via the central space C and around the outer rim of the rope reel 2), which a tie, band or equivalent, is later removed.

As presented in the disclosed embodiments, it is preferable that the support member(s) 6,6' are in supporting contact with the outer rim of the rope reel 2 along majority of the rim of the rope reel 2. Thus, the supporting force is evenly distributed and the rope is protected by the support member(s) 6,6'. In the preferred embodiments presented in FIGS. 1 and 2, the support members 6,6' delimit a cylindrical inner space 5,5' and surround radially said rope reel 2. The inner rim of the cylindrical inner space 5,5' is in contact with the rope reel 2 along majority of the rim of the rope reel 2, more specifically in FIG. 1 along the complete rim of the rope reel 2 and in FIG. 2 along more than 80% of the rim of the rope reel 2. However, alternatively the support members 6' could be distributed more sparsely. It is also not necessary that they have a curved arc form as illustrated, even though this is preferable so as to distribute the supporting forces evenly.

Figure 6:
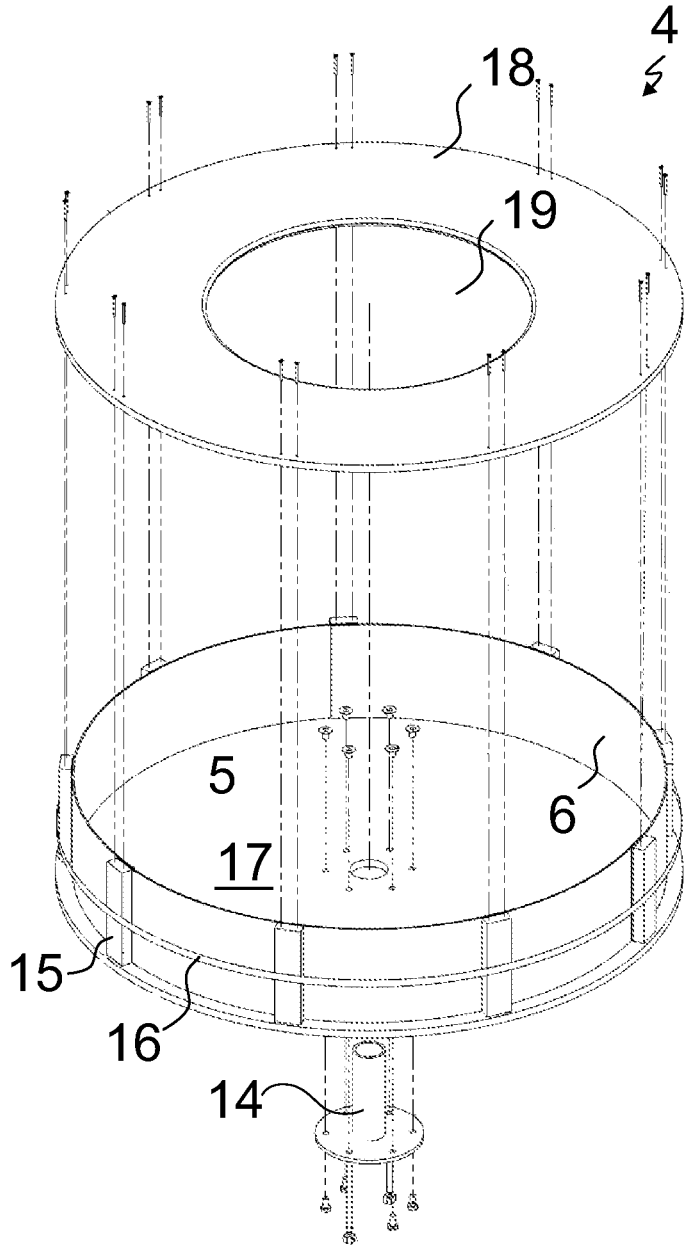
FIG. 6 illustrates further preferable details for the rope storage unit.

FIG. 6 illustrates (as an exploded view) further preferable details for the rope storage unit 1,1',1" implemented in connection with the support body 4 of the rope storage unit 1 of FIG. 1. The support body 4 comprises a support shaft 14 via which the rope storage unit 1,1',1" can be rotatably mounted. In the assembled state the support shaft 14 is positioned within the free central space C inside the rope reel 2, coaxially with the rope reel 2. The support body 4 further comprises a tightening band 15 surrounding the support member(s) 6 (here a single support member 6). In this way, the structure of the support body 4 is protected from distorting during transport for instance, as well as. In this case, there are support rods between the band 15 and the support member 6. The support body 4 further comprises a first axial side face plate 17 and a second axial side face plate 18 delimiting the inner space 5. One of said axial side face plate 17,18 comprises an opening 19 leading to the inner space 5, more specifically to the central space C, when the reel 2 is inside the support body 4. The opening 19 provides a side for the rope storage unit 1 in axial direction of the rope reel 2, which is fully or at least partially open or openable via which side the rope 3,3',3",3'" can be guided away from the rope reel 2.

Figure 7:
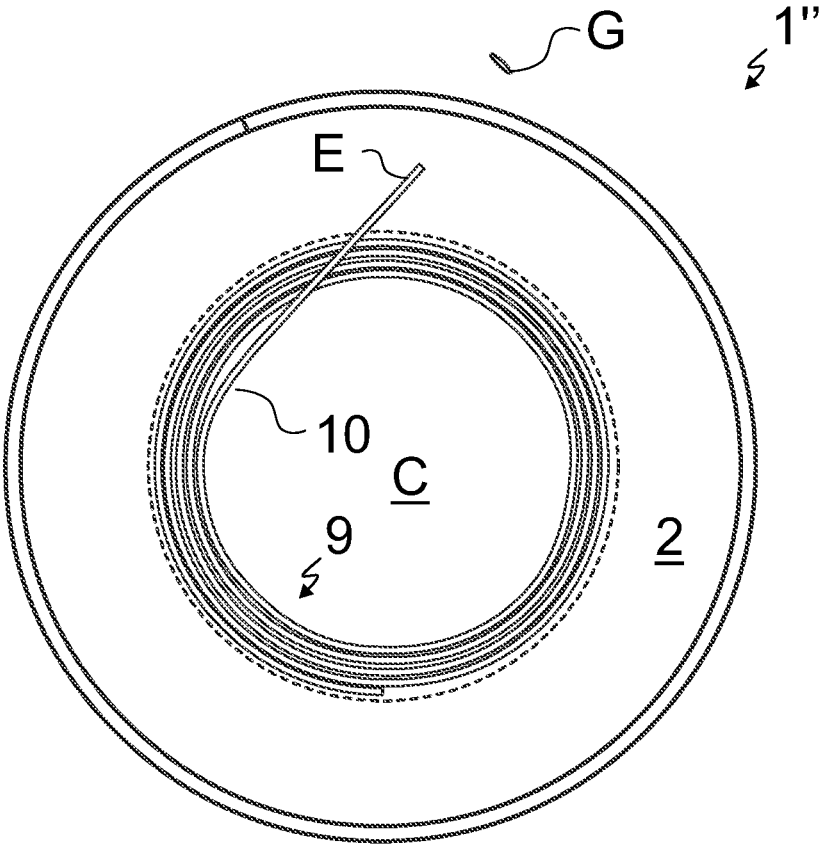
FIG. 7 illustrates a rope storage unit according to a third embodiment.

FIG. 7 illustrates an embodiment where a second rope 10, which is similar with the aforementioned rope 3,3',3",3'", is stored inside the aforementioned rope reel 2. The rope storage unit 1" here comprises a second rope reel 9, consisting of a second rope 10 wound in a spiral form the second rope 10 being a rod having a straight form when in rest state and elastically bendable away from the straight form, thereby being self-reversible to straight form from bent form after all bending directed to it ceases. The second rope 10 is under substantial bending tension in said spiral form, the outer rim of the second rope reel radially compressing against the inner rim of said first rope reel 2 (directly or via intermediate support elements, such as an intermediate padding, surrounding the second rope reel 9) as an effect of said bending tension. The second rope 10 is wound in a spiral form with several rope rounds, including at least an outermost rope round having an outer rim, and forming at least part of the aforementioned outer rim of the second rope reel 2, radially compressing against the inner rim of said first rope reel 2 (directly or via intermediate support elements surrounding the second rope reel 9) as an effect of said bending tension, as well as several inner rope rounds each having an outer rim radially compressing, as an effect of said bending tension, against the inner rim of the rope round next in radial direction. The inner rim of the rope reel 2 is illustrated with a broken line in FIG. 7. The second rope 10 is preferably wound and arranged to be unwound in similar way as described for rope reel 2.

The belt-like ropes as illustrated, have smooth surfaces. However, the ropes could be formed to have a contoured outer surface such as polyvee shapes or teeth, whereby each of said ropes has at least one contoured side provided with guide ribs and guide grooves oriented in the length direction of the rope or teeth oriented in the cross direction of the rope, said contoured side then being fitted to pass against a circumference of the drive wheel contoured in a matching way i.e. so that the shape of the circumference forms a counterpart for the shapes of the ropes. This kind of matching contoured shapes are advantageous especially for making the engagement firmer and less likely to slip.

In this application, the term load bearing member refers to the part that is elongated in the length direction of the rope continuing throughout all the length thereof, and which part is able to bear without breaking a significant part of the tensile load exerted on the rope in question in the length direction of the rope. The tensile load can be transmitted inside the load bearing member all the way from its one end to the other.

As described above said reinforcing fibers f are carbon fibers. However, alternatively also other reinforcing fibers can be used. Especially, glass fibers are found to be suitable for elevator use, their advantage being that they are cheap and have good availability although a mediocre tensile stiffness and weight.

The feature that the rope is a rod having a straight form when in rest state and elastically bendable away from the straight form means at least that a 1.0 meter length of the straight rope 3,3',3",3'" straightens back when released after a bending from straight form to a curved form, in which bending the rope 3,3',3",3'" is bent along its complete length to a curved form with a radius within the range of 0.3-0.5 meter. Thereby the feature can be tested for example by bending in this way.

The rope storage solution presented in the application suits especially well for the particular rope as presented. However, the rope storage solution presented suits well also for other kinds of ropes having a straight form when in rest state and elastically bendable away from the straight form.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A rope storage unit, comprising a rope reel, formed by a rope wound in a spiral form; and a support body provided with an inner space inside which the rope reel is positioned and supported by the support body, wherein the rope is a rod having a straight form when in rest state, elastically bendable away from the straight form and self-reversible back to the straight form from a bent form, the rope being under substantial bending tension in said spiral form, and wherein the support body comprises:

a plurality of support members delimiting said inner space and surrounding radially said rope reel, the outer rim of the rope reel radially compressing against said one or more support members as an effect of said bending tension, and each of the plurality of support members is spaced apart from each immediately adjacent support member thereof, wherein each of the support members is made of a fiber board member bent into curved shape with an arc conforming to the outer rim of the rope reel.

2. A rope storage unit according to claim 1, wherein said rope has width larger than thickness thereof in transverse direction of the rope, and the rope is wound in said spiral form by bending it around an axis extending in width-direction of the rope.

3. A rope storage unit according to claim 2, wherein the rope is wound in a spiral form with several rope rounds, including at least an outermost rope round having an outer rim radially compressing against said one or more support members as an effect of said bending tension, as well as several inner rope rounds each having an outer rim radially compressing, as an effect of said bending tension, against the inner rim of the rope round next in radial direction.

4. A rope storage unit according to claim 2 wherein said rope comprises one or more load bearing members made of composite material comprising reinforcing fibers in polymer matrix, said reinforcing fibers preferably being carbon fibers.

5. A rope storage unit according to claim 1, wherein the rope is wound in a spiral form with several rope rounds, including at least an outermost rope round having an outer rim radially compressing against said one or more support members as an effect of said bending tension, as well as several inner rope rounds each having an outer rim radially compressing, as an effect of said bending tension, against the inner rim of the rope round next in radial direction.

6. A rope storage unit according to claim 1, wherein said rope comprises one or more load bearing members made of composite material comprising reinforcing fibers in polymer matrix, said reinforcing fibers preferably being carbon fibers.

7. A rope storage unit according to claim 1, wherein said load bearing member(s) is/are parallel with the length direction of the rope.

8. A rope storage unit according to claim 1, wherein said reinforcing fibers are parallel with the length direction of the rope.

9. A rope storage unit according to claim 1, wherein said one or more support members delimit(s) a cylindrical inner space, said cylindrical inner space preferably having in axial direction open side via which the rope reel can be brought inside the inner space and/or via which the rope can be guided away from the rope reel.

10. A rope storage unit according to claim 1, wherein the support member(s) are in supporting contact with the outer rim of the rope reel along at least majority of the rim of the rope reel.

11. A rope storage unit according to claim 1, wherein the support body further comprises:

a support shaft via which the rope storage unit can be rotatably mounted;

an axial side face plate comprising an opening leading to the inner space to allow the rope to be guided away from the rope reel;

a tightening band surrounding the one or more support members; and a plurality of support rods positioned between the tightening band and the one or more support members, and fixed to the axial side face plate.

12. A rope storage unit according to claim 1, wherein the rope reel delimit(s) a free central space inside the rope reel, and the rope wound in a spiral form has an end extending from the inner rim of the rope reel, the rope being unwindable by guiding said end away from the rope reel via said free central space.

13. A rope storage unit according to claim 1, wherein the rope is wound in a spiral form with several rope rounds, including at least a radially outermost rope round, and a radially innermost rope round, the rope being unwindable rope round by rope round starting from the innermost rope round.

14. A rope storage unit according to claim 1, wherein the inner rim of the rope reel delimit(s) a free central space inside the rope reel, the central space having in axial direction open side via which the rope can be guided away from the rope reel.

15. A rope storage unit according to claim 1, wherein the rope is wound in a spiral form with several rope rounds, intermediate rope rounds between the innermost and outermost rope rounds, the intermediate rounds radially compressing against the next outer round as an effect of said bending tension.

16. A method for installing an elevator rope, comprising the steps of providing a rope storage unit according to claim 1; and unwinding the rope from the rope storage unit; and connecting the rope to one or more movable elevator units, said units including at least an elevator car and preferably also a counterweight.

17. A method according to claim 16, wherein the rope is wound in a spiral form with several rope rounds, including at least an radially outermost rope round, and an radially innermost rope round, and in said unwinding the rope is unwound rope round by rope round starting from the innermost rope round.

18. A method according to claim 16, wherein the rope reel delimit(s) a free central space inside the rope reel, and the rope wound in a spiral form has an end extending from the inner rim of the rope reel, and said unwinding comprises guiding said end away from the rope reel via said free central space.

19. A method according to claim 16, wherein the inner rim of the rope reel delimit(s) a free central space inside the rope reel, the central space having in axial direction open side via which the rope is guided away from the rope reel.

20. A method for fabricating a rope storage unit, comprising the steps of providing a rope, which is a rod having a straight form when in rest state, elastically bendable away from the straight form and self-reversible back to the straight form from a bent form;

providing a support body provided with an inner space, the support body comprising:

a plurality of support members delimiting said inner space, each of the plurality of support members being spaced apart from each immediately adjacent support member thereof;

forming a rope reel by winding the rope in a spiral form;

positioning the rope inside the inner space such that the rope is supported by the support body and surrounded radially by said one or more support members, and such that the rope is under substantial bending tension in said spiral form, the outer rim of the rope reel radially compressing against said one or more support members as an effect of said bending tension, wherein each of the support members is made of a fiber board member bent into curved shape with an arc conforming to the outer rim of the rope reel.

* * * * *